United States Patent [19]

Baatz et al.

[11] Patent Number: 4,675,129

[45] Date of Patent: Jun. 23, 1987

[54] METHOD OF HANDLING RADIOACTIVE WASTE AND ESPECIALLY RADIOACTIVE OR RADIOACTIVELY CONTAMINATED EVAPORATOR CONCENTRATES AND WATER-CONTAINING SOLIDS

[75] Inventors: Henning Baatz; Dieter Rittscher; Herbert Engelage, all of Essen, Fed. Rep. of Germany

[73] Assignee: GNS Gesellschaft fur Nuklear-Service mbH, Essen, Fed. Rep. of Germany

[21] Appl. No.: 766,755

[22] Filed: Aug. 16, 1985

[30] Foreign Application Priority Data

Aug. 16, 1984 [DE] Fed. Rep. of Germany ..... 3429981

[51] Int. Cl.[4] ..... G21F 9/16; G21F 9/08; G21F 9/12; G21F 9/22

[52] U.S. Cl. ..... 252/633; 159/47.3; 159/DIG. 12; 250/506.1; 252/626; 252/628; 252/631; 252/632

[58] Field of Search ..... 252/631, 628, 626, 632, 252/633; 159/23, 29, 31, 47.1, 47.3, DIG. 12; 250/506.1, 507.1, 518.1; 422/159; 376/272

[56] References Cited

U.S. PATENT DOCUMENTS

| | | | |
|---|---|---|---|
| 3,912,577 | 10/1975 | Akune et al. | 159/47.3 |
| 4,008,171 | 2/1977 | Tiepel et al. | 252/632 |
| 4,119,560 | 10/1978 | Sheeline | 159/47.3 |
| 4,246,233 | 1/1981 | Sheeline | 159/47.3 |
| 4,305,780 | 12/1981 | Black | 252/632 |
| 4,314,877 | 2/1982 | Queiser et al. | 159/47.3 |
| 4,444,680 | 4/1984 | Kitzes et al. | 252/632 |
| 4,559,170 | 12/1985 | Gay et al. | 159/DIG. 12 |
| 4,566,204 | 1/1986 | Friesner et al. | 252/632 |

FOREIGN PATENT DOCUMENTS

| | | | |
|---|---|---|---|
| 3200331 | 7/1983 | Fed. Rep. of Germany . | |
| 1379051 | 12/1964 | France | 159/DIG. 12 |
| 0030479 | 3/1978 | Japan | 159/47.3 |
| 0043200 | 4/1978 | Japan | 159/DIG. 12 |
| 0006520 | 2/1981 | Japan | 159/DIG. 12 |
| 0076201 | 6/1981 | Japan | 159/DIG. 12 |
| 0205898 | 11/1983 | Japan | 159/47.3 |

*Primary Examiner*—Stephen J. Lechert, Jr.
*Assistant Examiner*—Howard J. Locker
*Attorney, Agent, or Firm*—Karl F. Ross; Herbert Dubno

[57] ABSTRACT

Water-containing bibulous solids such as ion-exchange or filter matters from a nuclear electricity-generating power plant are introduced into a final storage container and heated therein under vacuum to dewater the solids and provide a high interstitial volume. The latter is substantially filled with radioactive salts by introducing flowable evaporator concentrate in one or more stages and for each stage heating the container under vacuum so as to drive off the concentrate water.

6 Claims, 1 Drawing Figure

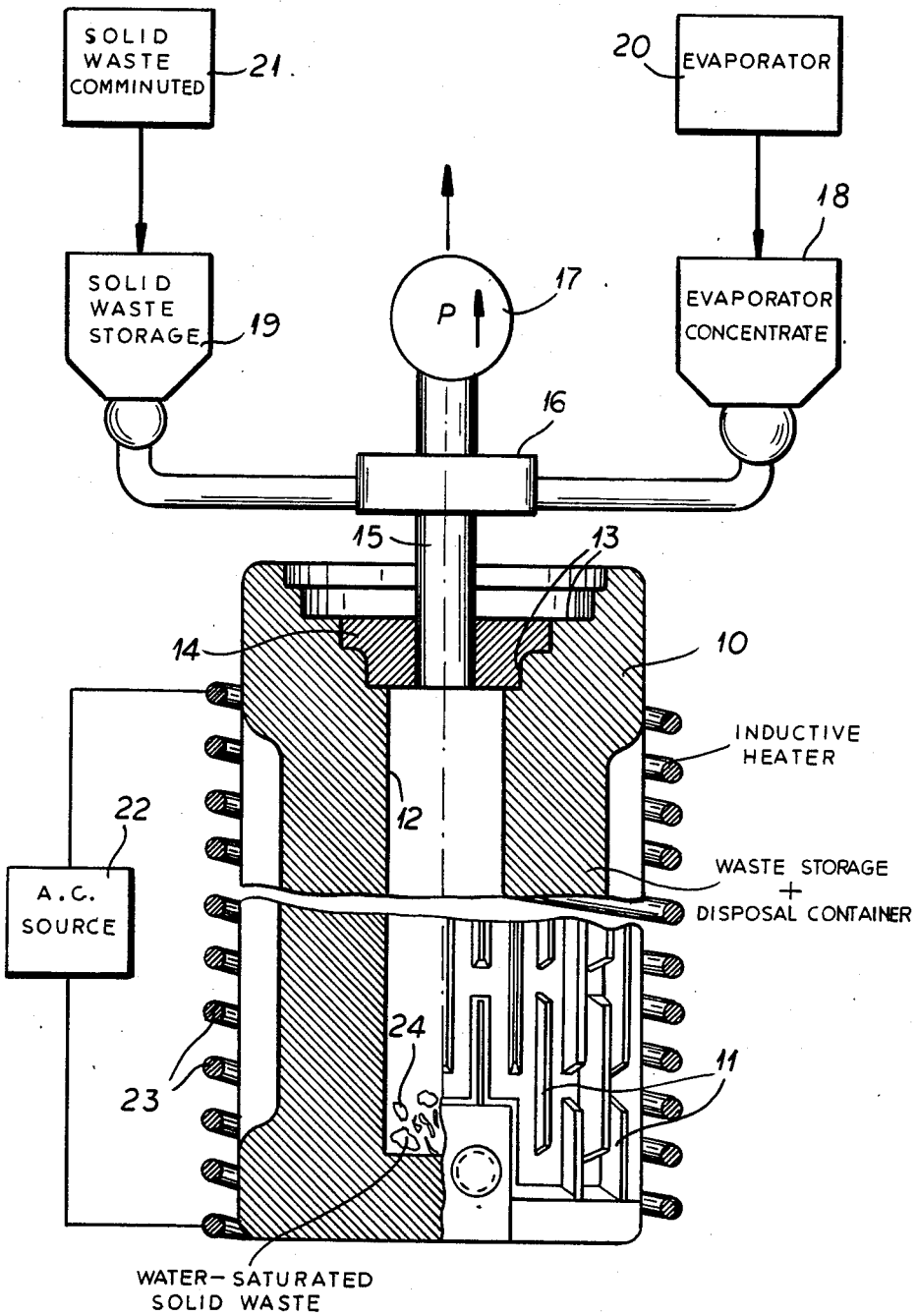
SOLID WASTE COMMINUTED
21
20
EVAPORATOR
18
SOLID WASTE STORAGE
19
P
17
EVAPORATOR CONCENTRATE
16
15
13
14
10
INDUCTIVE HEATER
12
22
A.C. SOURCE
WASTE STORAGE + DISPOSAL CONTAINER
24
23
11
WATER-SATURATED SOLID WASTE

METHOD OF HANDLING RADIOACTIVE WASTE AND ESPECIALLY RADIOACTIVE OR RADIOACTIVELY CONTAMINATED EVAPORATOR CONCENTRATES AND WATER-CONTAINING SOLIDS

CROSS REFERENCE TO RELATED APPLICATIONS

The present invention is related to the following commonly assigned copending applications:

Ser. No. 127,098, filed Mar. 4, 1980 (Abandoned);
Ser. No. 396,883, filed July 9, 1982;
Ser. No. 455,489, filed Jan. 4, 1983 (now U.S. Pat. No. 4,547,098);
Ser. No. 483,244, filed Apr. 8, 1983 (now U.S. Pat. No. 4,590,000);
Ser. No. 505,227, filed June 17, 1983;
Ser. No. 505,228, filed June 17, 1983;
Ser. No. 562,467, filed Dec. 16, 1983;
Ser. No. 607,197, filed May 4, 1984.

In addition, reference may be had to prior applications with which these or predecessor applications were copending and which have matured into U.S. patents as listed below:

U.S. Pat. No. 4,229,316, issued Oct. 21, 1980;
U.S. Pat. No. 4,235,739, issued Nov. 25, 1980;
U.S. Pat. No. 4,234,798, issued Nov. 18, 1980;
U.S. Pat. No. 4,272,683, issued June 9, 1981;
U.S. Pat. No. 4,278,892, issued July 14, 1981;
U.S. Pat. No. 4,288,698, issued Sept. 8, 1981;
U.S. Pat. No. 4,274,007, issued June 16, 1981;
U.S. Pat. No. 4,528,454, issued July 9, 1985;
U.S. Pat. No. 4,445,042, issued Apr. 24, 1984;
U.S. Pat. No. 4,447,733, issued May 8, 1984.

FIELD OF THE INVENTION

Our present invention relates to the disposal of radioactive wastes and, more particularly, to the disposal of radioactive or radioactively contaminated materials which include water-containing solids which have a bibulous character or high pore volume upon drying and evaporator concentrates containing radioactive or radioactively contaminated salts.

BACKGROUND OF THE INVENTION

From the aforementioned applications and patents and the art and literature cited therein, it is clear that the disposal of radioactive wastes by concentrating them to a maximum possible extent and introducing the radioactive waste into containers which can be sealed, is well known and has long been recognized as a desirable solution to the disposal problem. The containers which can be used are generally thick-wall containers which can be composed, for example, of cast iron, and have walls which are capable of absorbing the radiation emitted by the contents of the container.

In spite of the fact that the art of handling radioactive wastes for such disposal is relatively well developed, problems are still encountered with materials having comparatively weak radioactive or slight radioactive contaminations since such materials are produced in large quantities in nuclear reactor installations and the equipment hitherto required for concentrating such materials is expensive to fabricate, maintain and operate. The problem is especially pronounced in nuclear electricity-generating power plants where evaporator concentrates and solid filter products may have to be disposed of.

Solid wastes of the type with which the present invention is primarily concerned are generally ion-exchange resins which are used in filtering and water-cleaning apparatus in a nuclear power plant, although cellulosic filter materials such as filter tubes, rods and candles also fall into this category. Because all of these solids are able to take up water and are generally recovered from the nuclear power plant impregnated with water and radioactively contaminated to a greater or lesser extent, they have been considered to have a high pore volume and will be referred to hereinafter as water-impregnated bibulous solids.

Another radioactive waste generated in comparatively large quantities in nuclear power plants and requiring disposal is the radioactive or radioactively contaminated evaporator concentrate which has a high radioactive salt concentration but is nevertheless flowable.

In the discussion below, reference will be made to the evacuation of a final storage container for radioactive wastes and to the application of vacuum thereto and for the purposes of this invention the term "vacuum" will be understood to mean a vacuum of sufficient depth to permit vacuum drying or dewatering (see, for example, German patent document DE-OS No. 32 00 331). Such vacuums generally must be generated by vacuum pumps.

We also will refer to final storage containers herein, meaning thereby to indicate the containers in which the radioactive residue is to remain for ultimate disposal, i.e. containers which can be sealed after the process is completed without removal of the radioactive residue therefrom, utilized for transportation of the radioactive waste to the subterranean or other disposal site, and placed at that site for permanent disposal of the residue. Such containers are composed of substances which, like cast iron, can absorb radiation effectively and have a sufficient thickness that they can act, for example, as total neutron absorbers. As the aforementioned patents indicate, the walls of such containers can also be provided with neutron moderator materials or the like.

It may be noted that in the past water-containing solid wastes have been subjected to vacuum drying and, indeed, that evaporator concentrates have been transformed into salts, both radioactive residues being incorporated radioactively in a mass with a binder such as cement, synthetic resin or glass. While these practices have proven to be effective, they are difficult to carry out and expensive, especially since the dried bibulous solids have a very large pore volume so that the volume of the storage container or final disposal container is only partially utilized by reason of the space remaining in the interstices of the bibulous solids.

It is known, for example, to mechanically compact such solids to reduce this wasted volume, but the compaction process is a step which is comparatively costly and may be difficult to carry out at least in some cases.

OBJECTS OF THE INVENTION

It is the principal object of the present invention to provide an improved method of disposing of the radioactive wastes described without the drawback of the earlier approaches.

Another object of the invention is to provide such a method which is capable of minimizing wasted space in conjunction with bibulous solids radioactively contaminated or radioactive waste.

SUMMARY OF THE INVENTION

These objects and others which will become apparent hereinafter are attained, in accordance with the present invention, in a method whereby the water-containing radioactive or radioactively contaminated bibulous solid waste is introduced into the receiving compartment of the final storage container and is heated under vacuum therein to drive off the water, i.e. is dewatered, to effect a volume reduction. Flowable evaporator concentrate is then introduced into this compartment which is maintained under vacuum, while the vacuum is maintained therein, and preferably at least in part by the suction effect of this vacuum. The heating of the resulting mass is repeated under vacuum to remove the water from the concentrate.

The invention has been found to be particularly effective when all or part of the bibulous solid mass is a water-containing ion-exchange resin. Such ion-exchange resins may be introduced into the container with about 50 weight % water which is largely removed in the first step of the invention and repeated by the evaporator concentrate. This step alone reduces the mass which must be stored by about 50%. Since the concentrate water is also largely or completely driven off to deposite the radioactive salts in the interstices of the bibulous solid, the pores of the solid can be filled practically completely, thereby eliminating the pore volume as wasted storage space.

The water-containing bibulous solids can also be filter rods or candles of other filter materials which are preferably comminuted before they are introduced into the container.

The filling of the interstitial spaces of the solid material introduced into the container with radioactive salts can be improved if, according to a feature of the invention, after a concentrate dewatering, an additional quantity of the flowable evaporator concentrate is introduced and the contents of the container again dewatered by heating under vacuum. The second step of the process of the invention can thus be practiced a number of times to bring about a very intensive loading of the interstitial volume with radioactive or radioactively contaminated salts.

The result, of course, is a considerable increase in the storage capacity of the container.

It has been found to be advantageous in some cases to admix the solid wastes before or after dewatering with solids, preferably comminuted radioactive components which can be predried. Such components can include, for example, comminuted metals.

It should be noted further that the salts are deposited not only in the pores of the solid particles but also in the spaces between them, i.e. in the entire interstitial volume.

BRIEF DESCRIPTION OF THE DRAWING

The above and other objects, features and advantages of the present invention will become more readily apparent from the following description, reference being made to the accompanying drawing in which the sole FIGURE is a diagram partly in section, illustrating the process of the present invention.

SPECIFIC DESCRIPTION

In the drawing we have shown a final storage container 10 (see the aforementioned patents) which can be composed of cast iron and can have thick walls preventing penetration of radiation from the chamber 12 to the exterior. This container may be of the type described in the aforementioned patents and can be provided externally with fins 11 which serve to facilitate dissipation of heat to the exterior during storage of the radioactive waste, but also can permit heating of the contents of the container as will be described.

The mouth 13 of the container is tapered and stepped to receive one or more sealing covers which can be applied as the aforementioned patents describe. In the seat 13 of the mouth, a plug 14 is sealingly applied to carry the pipe 15 which connects the interior of the containers to a distributing valve 16 selectively connecting a suction pump 17 to the chamber 12 or an evaporator concentrate hopper 18 to the container 12 or a solid waste hopper 19 to the container 12.

The evaporator concentrate hopper 18 receives the flowable concentrate of radioactive or radioactively contaminated salts from the evaporator 20 of a nuclear reactor power plant.

Bibulous water-containing radioactively contaminated solid waste, including cellulosic filters and ion-exchange resins can be comminuted at 21 and the water-containing solid then transferred to the hopper 19.

An induction heating coil 23 surrounds the container 10 and is energized by an alternating current source.

In operation, the pump 17 first evacuates the chamber 12 and then, under the suction in this chamber and through an appropriate gate, the bibulous and water-saturated solid waste is drawn from the hopper 19 into the container. Suction is then applied and the container heated to dewater this mass which is shown at 24. The mass 24 has a high interstitial volume, upon dewatering, so that when the valve 16 connects the hopper 18, the vacuum draws evaporator concentrate into the container to fill this interstitial volume. While suction is maintained, the container is again heated to drive off the concentrate water and deposit salts in the interstitial volume. The latter series of steps can be repeated until the entire chamber is filled with a highly dense mass of the bibulous solids in the interstices and pores of which the radioactive salts are deposited.

We claim:

1. A method of handling radioactive waste which comprises the steps of:

(a) introducing in original solid form a water-containing radioactively contaminated bibulous nuclear-waste solid into a final storage container;

(b) applying suction to said container while heating same to dewater said bibulous solid and form an interstitial free-pore volume in the mass thereof;

(c) introducing into said container a flowable evaporator concentrate containing radioactive salts whereby said evaporator concentrate permeates said interstitial volume while maintaining said container under vacuum; and (d) heating said container with the contents thereof under vacuum to evaporate concentrate water therefrom and deposit said salts in an interstitial volume.

2. The method defined in claim 1 comprising the step of sealing said container upon substantial filling of said interstitial volume with said salts.

3. The method defined in claim 1 wherein said bibulous solids include an ion-exchange resin.

4. The method defined in claim 1 wherein said bibulous solids include comminuted filter materials.

5. The method defined in claim 1 wherein steps (c) and (d) are repeated in succession to build up the salts in said interstitial volume.

6. The method defined in claim 1 wherein comminuted solid radioactive or radioactively contaminated substances are mixed with said bibulous solids.

* * * * *